US005508677A

United States Patent [19]

Neubert et al.

[11] Patent Number: 5,508,677

[45] Date of Patent: Apr. 16, 1996

[54] LIQUID-COOLED HEAVY-DUTY RESISTOR

[75] Inventors: Rolf Neubert, Herzogenaurach; Alfred Bochtler, Wachenroth, both of Germany

[73] Assignee: Siemens Aktiengesellschaft, Munich, Germany

[21] Appl. No.: 211,114

[22] PCT Filed: Sep. 8, 1992

[86] PCT No.: PCT/DE92/00762

§ 371 Date: Mar. 21, 1994

§ 102(e) Date: Mar. 21, 1994

[87] PCT Pub. No.: WO93/06605

PCT Pub. Date: Apr. 1, 1993

[30] Foreign Application Priority Data

Sep. 19, 1991 [DE] Germany ..... 9111719 U

[51] Int. Cl.[6] ..... H01C 1/08

[52] U.S. Cl. ..... 338/53; 338/55

[58] Field of Search ..... 338/53, 54, 55

[56] References Cited

U.S. PATENT DOCUMENTS

| | | | |
|---|---|---|---|
| 2,254,838 | 9/1941 | Conklin et al. | 338/55 |
| 3,156,889 | 11/1964 | Starner | 338/55 |
| 3,858,146 | 12/1974 | Simonsen et al. | 338/55 |
| 4,420,739 | 12/1983 | Herren | 338/53 |
| 4,434,417 | 2/1984 | Beriger et al. | 338/53 |
| 5,353,005 | 10/1994 | Salanki | 338/55 |

FOREIGN PATENT DOCUMENTS

| | | |
|---|---|---|
| 0066902 | 11/1986 | European Pat. Off. . |
| 410792 | 9/1923 | Germany . |
| 3639239.1 | 4/1990 | Germany . |
| 9111719.4 | 12/1991 | Germany . |
| 24679 | 12/1912 | United Kingdom . |

*Primary Examiner*—Teresa J. Walberg
*Assistant Examiner*—Tu Hoans
*Attorney, Agent, or Firm*—Kenyon & Kenyon

[57] ABSTRACT

A liquid cooled, heavy duty resistor including a housing and a resistor element. The resistor element is arranged inside a chamber defined by the housing. The resistor element and the housing form a rectangular duct through which a cooling liquid flows from an inlet to an outlet. The chamber is defined by two insulating plates and an insulating ring. The resistor element is a bifilar wound spiral strip conductor and is clamped between two insulating plates such that the cooling liquid flows through the rectangular duct. The liquid cooled, heavy duty resistor can remove a high dissipated power in a small space, has low inductance, and has a low resistance value.

7 Claims, 3 Drawing Sheets

LIQUID-COOLED HEAVY-DUTY RESISTOR

BACKGROUND OF THE INVENTION

The present invention relates to a liquid-cooled heavy-duty resistor.

A liquid-cooled power resistor is known from European Patent No. EP 0,066,902 B1. This liquid-cooled power resistor consists of a cylindrical housing provided with two flanges. The housing is closed at its ends with a top cover plate and a bottom cover plate. The flanges are constructed in cuboid form so that their corners protrude past the cylinder and are used for connecting the cover plates with mounting screws. The closed housing is provided with two ports for the supply of deionized water, an inlet bore provided in a bottom connection and an outlet bore being provided in a top connection.

Four deflector plates are mounted in the interior of the housing. These deflector plates alternately leave one flow cross section each open on the left and on the right and are used for deflecting the deionized water. The deflector plates are provided with bores through which a serpentine resistor conductor is carried. The deflector plates therefore also function as holders for the resistor conductor. The upper cover plate and lower cover plate are each provided with a connecting pin and fixed in location by means of a nut. The ends of the resistor conductor are connected to these connecting pins.

In this embodiment of the liquid-cooled power resistor, the cylinder with the flanges consists of aluminum and the cover plates consist of polypropylene. The deionized water used as cooling liquid runs through the power resistor and is continuously conditioned in bypass mode.

Arranging the resistor conductor directly in the cooling liquid ensures effective and uniform heat removal, the heat capacity being relatively high. In spite of the serpentine-like or meander-shaped arrangement of the resistor conductor, unfortunately this liquid-cooled power resistor still has a high inductance. In addition, its resistance value is relatively high, for example 10Ω to 100Ω.

From the German Patent Application No. DE 36 39 239 A 1, a liquid-cooled resistor is known which consists of a hollow body with a resistor carrier arranged in its interior space. Resistance wire is wound about the resistor carrier. The hollow body and the resistor body consist of insulating material and are spaced apart from one another by an intermediate space forming a cooling duct. The cooling duct is connected to a coolant inlet at the lower end of the hollow body and to a coolant outlet at the upper end of the hollow body. The resistor carrier consists of a rod-shaped body with radially arranged arms on which the resistance wire is bidirectionally wound. Each of the ends of the resistance wire are connected to an electrical terminal. A resistor liquid-cooled in this manner has low inductance and can remove high dissipated power. Unfortunately, such resistors disadvantageously have low insulating strength and the cooling liquid must not be electrically conductive. Since a thin wire is used as a resistor conductor, the resistance value of such a liquid-cooled resistor is very high.

Therefore, there is a need for a liquid-cooled heavy-duty resistor which can remove high dissipated power in a small space, has low inductance and exhibits a very low resistance value.

SUMMARY OF THE INVENTION

The present invention fulfills the above needs by providing a chamber including two insulating plates and an insulating ring and by providing a bifilar-wound spiral strip conductor as a resistor element. The bifilar-wound spiral strip conductor is clamped between the two insulating plates such that the cooling liquid flows through a rectangular duct defined by the two insulating plates and the spiral strip conductor.

Since, the resistor element is arranged directly in the cooling liquid, the cooling liquid flows along both sides of the current-conducting resistor element. As a result, high dissipated power can be removed to the cooling liquid. Since the resistor element is constructed as bifilar-wound spiral strip conductor, the inductance of the heavy-duty resistor is minimized. A flat strip is selected as resistor material since, due to its geometry, it exhibits low inherent inductance in comparison with a conductor having a circular cross-section.

In a preferred embodiment of the present invention, the conductor strip of the resistor element is provided with an insulating layer. The insulating layer can be a ceramic material coating the conductor strip. In such an embodiment, electrically conductive cooling liquid can be used as cooling liquid, for example service water. Similarly, oil can be used as cooling liquid. If the conductor strip of the resistor element is not insulated, deionized water can be used as cooling liquid.

In a preferred embodiment of the heavy-duty resistor of the present invention, the resistor element is mechanically fixed in location on at least one insulating plate with projecting knobs. The knobs are made of an electrically non-conductive material, for example plastic. The use of knobs simplifies the assembly of the individual parts forming the heavy-duty resistor and the resistor spiral exhibits a uniform pitch along the flat resistor strip. As a result, a duct formed along the flat strip exhibits a uniform cross section.

In a further embodiment, the resistor element is mechanically fixed in location with a bifilar groove in an insulating plate of the heavy-duty resistor.

In a particularly advantageous embodiment of the heavy-duty resistor of the present invention, an insulating plate and an insulating ring of this heavy-duty resistor form one constructional (i.e., an integral or one-piece) shape. The assembly of this embodiment is considerably simplified because the resistor element can first be installed in the chamber of the heavy-duty resistor formed and can be closed, liquid-tight, by means of the second insulating plate in a subsequent production step of this preassembled heavy-duty resistor. Since that one constructional unit is used, only one sealing ring is needed.

The construction of the liquid-cooled heavy-duty resistor of the present invention permits the inductance to be reduced considerably compared with the known heavy-duty resistors.

The space needed for such a heavy-duty resistor of the present invention is small. The resistance value can be predetermined by changing the length, the width or the thickness of the conductor strip material. Varying the conductor strip thickness is appropriate for an existing design of the housing.

The dissipated power to be removed is determined, in part, by the volume of liquid flowing through the resistor per unit time. In the heavy-duty resistor according to the present invention, the liquid can flow once or twice around the spiral strip conductor. In the first-mentioned operating mode, the cooling liquid flows from an inlet to the center of the heavy-duty resistor (i.e., the turning point of the bifilar-wound spiral strip conductor) and back to an outlet. In the second operating mode mentioned, a further inlet and outlet are arranged in the turning area of the bifilar-wound spiral strip conductor. This produces two parallel cooling ducts through which cooling liquid can flow in the same direction or in opposite directions. In this operating mode, twice the volume of cooling liquid can flow through the heavy-duty resistor per unit time. As a result, the dissipated power removed to the cooling liquid also doubles without changing the space required for the heavy-duty resistor.

DETAILED DESCRIPTION

Figure 1:
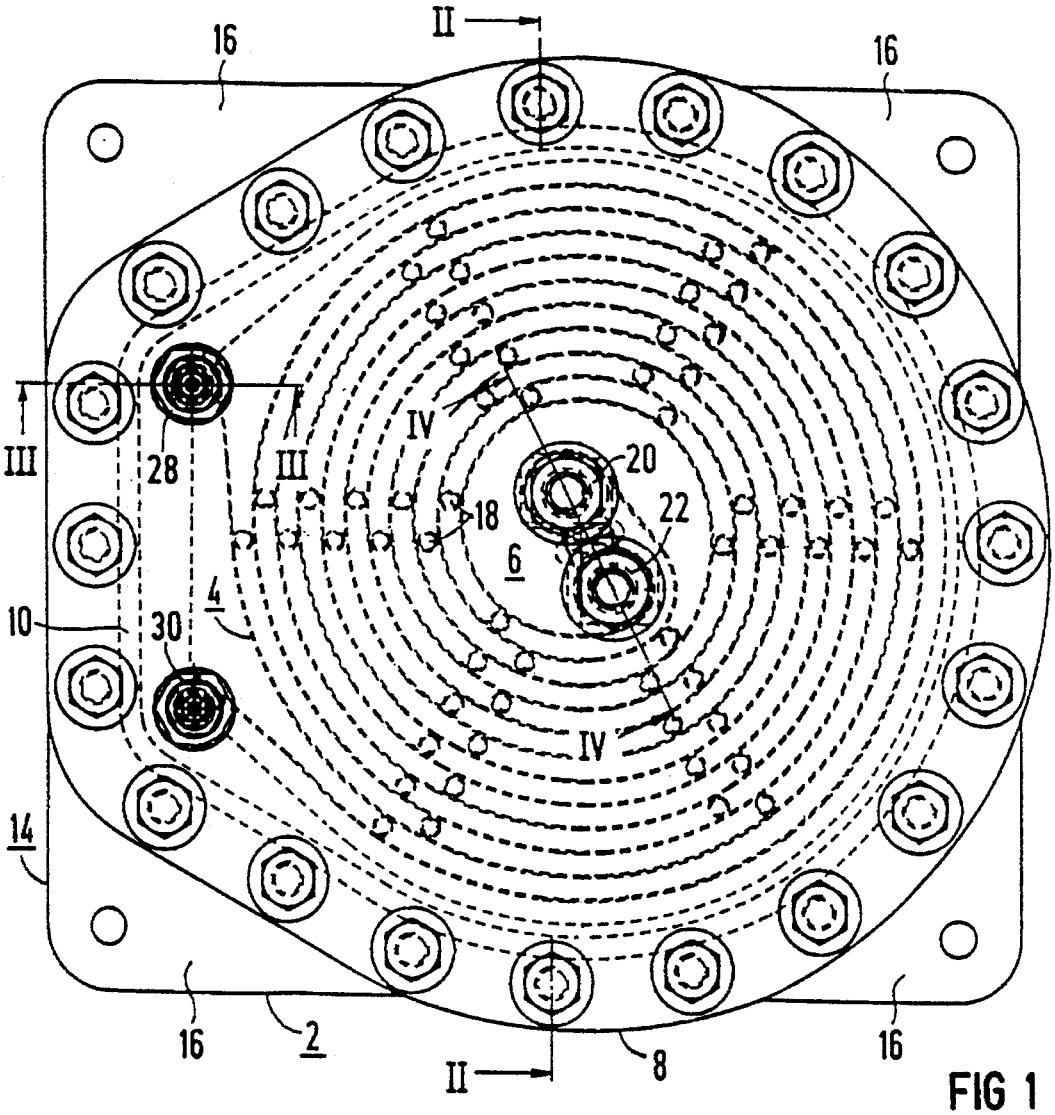
FIG. 1 illustrates a top view of the heavy-duty resistor according to the present invention.
Figure 2:
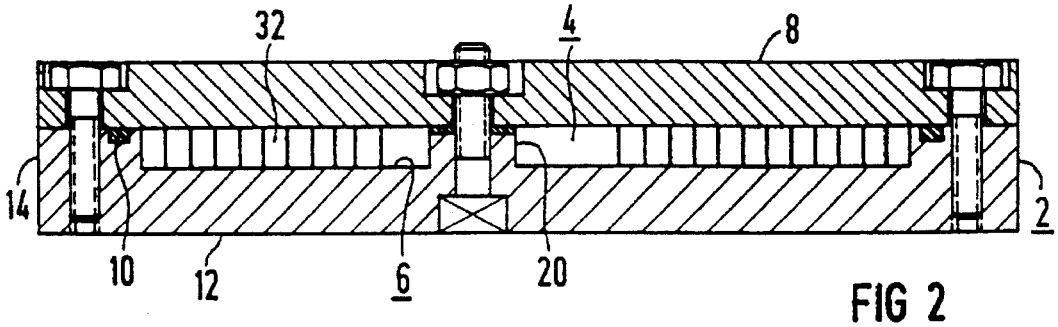
FIG. 2 illustrates a cross-sectional view of the heavy-duty resistor of FIG. 1 along line II—II.

FIG. 1 illustrates a top view of the liquid-cooled heavy-duty resistor according to the present invention. The heavy-duty resistor includes a housing 2 and a resistor element 4 (shown in greater detail in FIG. 3). FIG. 2 is a cross-sectional view of FIG. 1 along line II—II. The housing 2 of the heavy-duty resistor defines a chamber 6 in which the resistor element 4 is arranged and includes a cover 8. An insulating plate is detachably locked, liquid-tight, to the chamber 6 with a peripheral sealing ring 10 and is provided as cover 8. The cover 8 can also be non-detachably connected to the chamber 6. The chamber 6 is defined by an insulating plate 12 and an insulating ring 14. The corners of the insulating ring 14 are flanges or mounting tabs 16. The insulating plate 12, which defines the bottom of the chamber 6, is also closed, liquid-tight, with a peripheral sealing ring. In a preferred embodiment of the heavy-duty resistor, the insulating ring 14 and the insulating plate 12 form one constructional (i.e., an integral or one-piece) unit.

To mechanically fix the resistor element 4 in its proper location on the insulating plate 12, projecting knobs 18 of electrically non-conductive material are provided on the insulating plate 12. These knobs 18 are, in each case, alternately disposed on both sides of imaginary radial lines on the insulating plate 12. Deflection spigots 20 and 22 are arranged in the interior of the resistor element 4. The deflection spigots 20 and 22 are shown in greater detail in FIG. 6. The electrical terminals 24 and 26 (see FIG. 4) of the resistor element 4 are arranged in the edge area of the chamber 6. An inlet 28 and an outlet 30 for the coolant are also arranged in the edge area of the chamber 6 in the insulating plate 8.

As is shown in FIG. 2, the resistor element 4 is clamped in the chamber 6 with the insulating plate 8 and the detachable mounting elements such that the cooling liquid flows through a rectangular duct 32.

Figure 3:
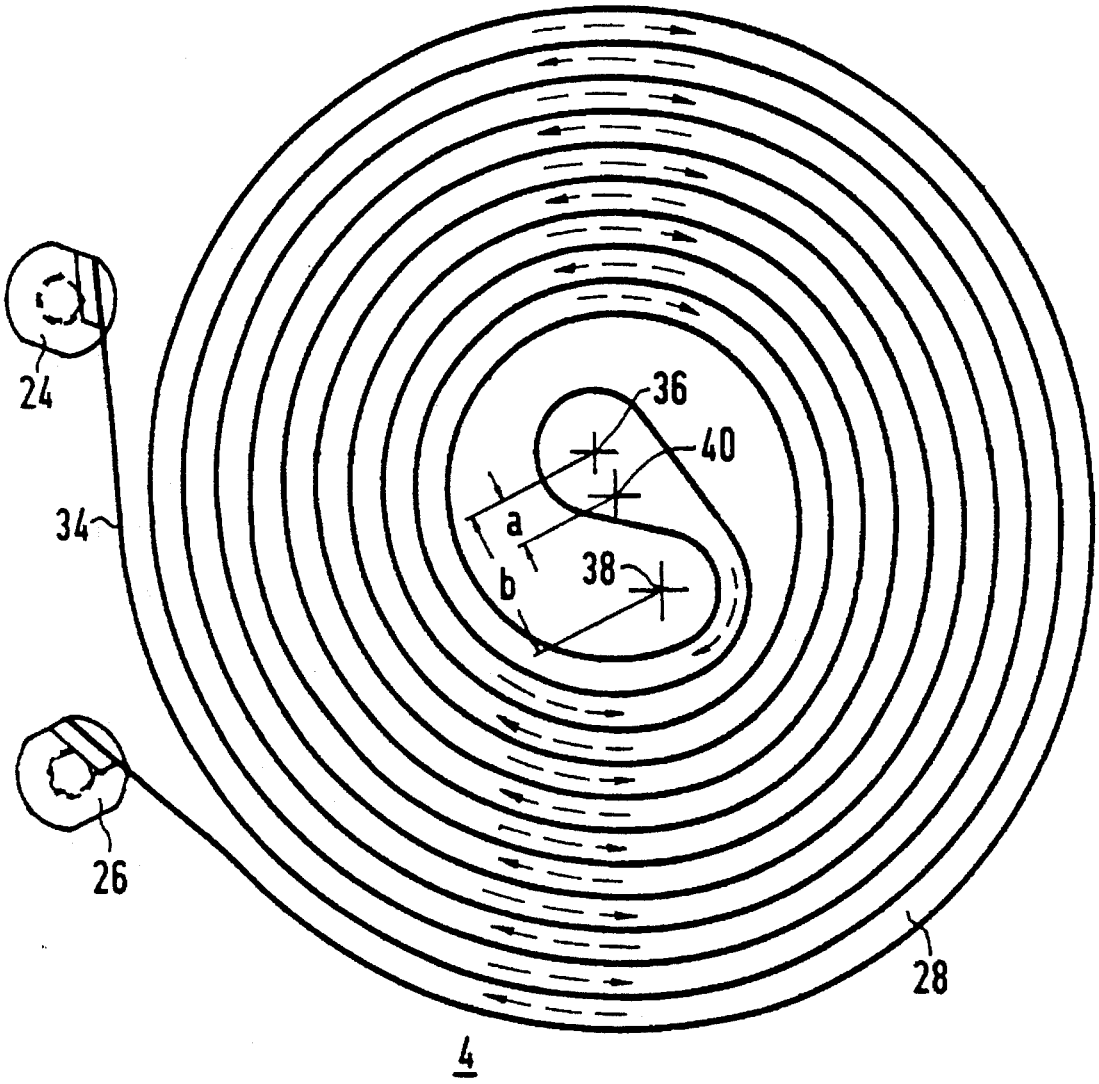
FIG. 3 shows the resistor element of the present invention in greater detail.

The resistor element 4 is shown in greater detail in FIG. 3. A bifilar-wound spiral strip conductor 34 is provided as resistor element 4. Each end of the strip conductor 34 is provided with an electrical terminal 24 and 26. A stainless steel strip having the following dimensions 0.5×10×4,000 $mm^3$ can be provided, for example, as resistor material. At the centers 36 and 38 of the bifilar-wound spiral strip conductor 34, the deflection spigots 20 and 22 are arranged eccentrically with respect to the center 40 of the chamber 6 of the heavy-duty resistor. The distance of the center 36 from the center 40 is identified by "a" and the distance of the center 38 from the center 36 is identified by "b". These distances allow the bending radii of the conductor strip of the resistor element 4 to be determined.

A further inlet (or a further outlet) can be arranged in addition to the deflection spigot 20 at the center 36 and a further outlet (or a further inlet) can be arranged in addition to the deflection spigot 22 at the center 38. Due to the bifilar-wound spiral strip conductor 34 and due to the centrally arranged deflection spigots 20 and 22, a spiral duct 32 having a rectangular cross-section is obtained. The direction of flow of the cooling liquid in any duct 32 is opposite to the flow of cooling liquid in an adjacent duct. These two flow directions are identified with broken arrows in FIG. 3. By providing the further inlet and the further outlet, the single-duct design of the liquid-cooled heavy-duty resistor is converted into a dual-duct embodiment. The coolant can flow in the same direction or in opposite directions in the two ducts depending on the placement of the inlet 28, the outlet 30, the further inlet and the further outlet. By providing the second duct, the rate of flow of the cooling liquid can be doubled. As a result, the dissipated power to be removed is also doubled.

Since the conductor current is supplied and removed at the electrical terminals 24 and 26, current flows in opposite directions through the individual spiral paths. As a result, the resultant inductance of the resistor element 4 is minimized. Further, the resistor material has the form of a flat strip (see FIG. 4), which has a lower inherent inductance than a conductor having a round cross-section due to its geometry. Hence, the geometry of the flat strip also helps to minimize the inductance.

Figure 4:
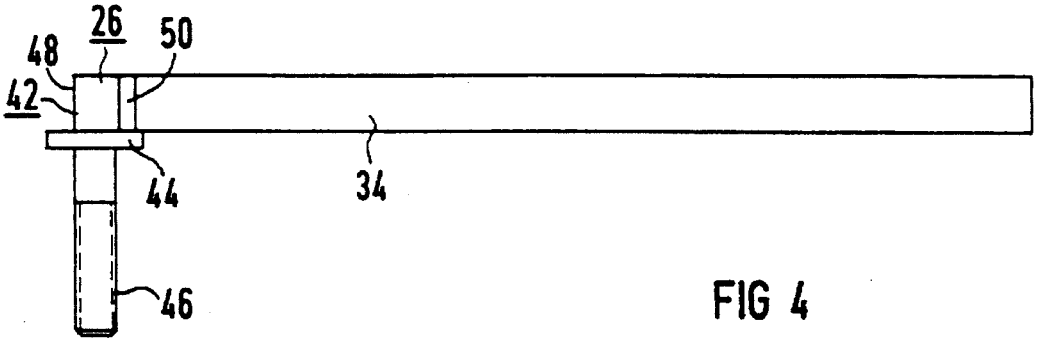
FIG. 4 shows an embodiment of the electrical terminal of the resistor element of the heavy-duty resistor.

The electrical terminals 24 and 26, (only terminal 26 is shown in FIG. 4) each include a connector bar 42 which is arranged on a disc 44. A threaded bolt 46 is attached on the side of the disc 44 facing away from the connector bar 42. The spiral strip conductor 34 is electrically conductively connected with its free end to the connector bar 42. When installed, a front end 48 of the connector 42 is flush with the insulating ring 14 (chamber wall) and a connector bar side 50 directed towards the entrance of the cooling duct 32 is bevelled so that the cooling liquid can enter and leave with as little turbulence as possible.

Figure 5:
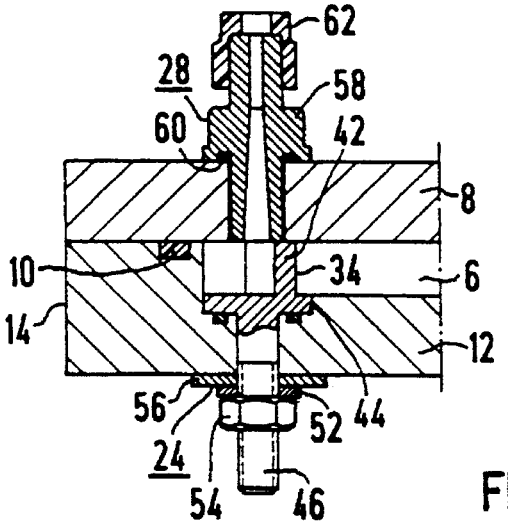
FIG. 5 shows a cross-sectional view of the heavy-duty resistor of FIG. 1 along line III—III.

FIG. 5 shows a cross-sectional view of FIG. 1 along line III—III. FIG. 5 shows, on the one hand, an electrical terminal 24 and, on the other hand, the inlet 28 arranged in the insulating plate 8. The electrical terminal 24 includes the aforementioned connector bar 42, disc 44 and threaded bolt 46 ( see FIG. 4) and further includes a connecting conductor 52 which is electrically conductively connected to the threaded bolt 46 with a nut 54 and a washer 56. The inlet 28 includes a stub 58 which is anchored, liquid-tight, in the insulating plate 8 with a seal 60. A coolant hose 62 of a cooling system, not shown in greater detail, is pushed onto the stub 58. Cooling liquid flows through the hose 62 and the stub 58 into the entrance of the cooling duct 32, the opening of which is in the sectional plane. That is, the cooling liquid emerges vertically out of the plane of the drawing.

Figure 6:
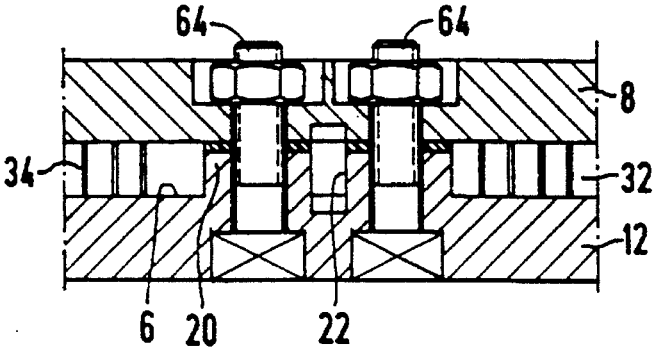
FIG. 6 shows a cross-sectional view of the heavy-duty resistor of FIG. 1 along line IV—IV.

FIG. 6 shows cross-sectional view of FIG. 1 along line IV—IV. This representation shows the deflection spigots 20 and 22 in the center of the chamber 6 of the heavy-duty resistor. These deflection spigots 20 and 22 are, in each case, also used for accommodating a detachable mounting means 64. With the detachable mounting means 64, the bifilar-wound spiral strip conductor 34 is also pressed into the chamber 6 at the center of the heavy-duty resistor.

Due to the development according to the present invention, this liquid-cooled heavy-duty resistor exhibits a resistance value of only 0.8Ω with a load-carrying capacity of 5 kW at a flow rate of 3 l/min in the single-duct construction. The dual-duct embodiment exhibits a load-carrying capacity of 10 kW at a flow rate of 6l/min.

We claim:

1. A liquid cooled, heavy duty resistor comprising:

a) a housing, said housing including a first insulating plate, a second insulating plate, and an insulating ring defining a chamber having an inlet and an outlet; and b) a bifilar wound spiral strip conductor resistor element, said resistor element i) arranged within said chamber, and ii) clamped between said first insulating plate and said second insulating plate to define a cross-sectional rectangular duct with said first insulating plate, said second insulating plate, and said insulating ring, said rectangular duct to provides a pathway between said inlet and said outlet for cooling liquid.

2. The liquid cooled, heavy duty resistor of claim 1 wherein said strip conductor resistor element is coated with an insulating layer.

3. The liquid cooled, heavy duty resistor of claim 1 wherein said second insulating plate includes a plurality of knob projections, said plurality of knob projections mechanically fixing, and positioning, said resistor element to, and on, said second insulating plate.

4. The liquid cooled, heavy duty resistor of claim 1 wherein said second insulating plate and said insulating ring are a single integrated unit.

5. The liquid cooled, heavy duty resistor of claim 1 wherein said inlet and said outlet are arranged at an edge area of said chamber.

6. The liquid cooled, heavy duty resistor of claim 1 further comprising:

a first terminal coupled with a first end of said bifilar wound spiral strip conductor resistor element and a second terminal coupled with a second end of said bifilar wound spiral strip conductor resistor element, said first and second terminals located at an edge area of said chamber.

7. The liquid cooled, heavy duty resistor of claim 6 wherein said first and second terminals are axially aligned with said inlet and said outlet and are arranged opposite said inlet and said outlet.

* * * * *